US007347271B2

(12) United States Patent
Ohmer et al.

(10) Patent No.: US 7,347,271 B2
(45) Date of Patent: Mar. 25, 2008

(54) WIRELESS COMMUNICATIONS ASSOCIATED WITH A WELLBORE

(75) Inventors: Herve Ohmer, Houston, TX (US); Klaus Huber, Sugar Land, TX (US); Randolph J. Sheffield, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 251 days.

(21) Appl. No.: 11/161,342

(22) Filed: Jul. 29, 2005

(65) Prior Publication Data

US 2006/0086497 A1 Apr. 27, 2006

Related U.S. Application Data

(60) Provisional application No. 60/522,673, filed on Oct. 27, 2004.

(51) Int. Cl.
*G01V 3/00* (2006.01)

(52) U.S. Cl. ..... 166/366; 324/338; 340/854.6

(58) Field of Classification Search ..... 166/335, 166/336, 366; 324/338; 340/854.6
See application file for complete search history.

(56) References Cited

U.S. PATENT DOCUMENTS

| | | | |
|---|---|---|---|
| 4,755,944 A | 7/1988 | Glass | |
| 5,187,440 A | 2/1993 | Vail, III | |
| 5,576,703 A | 11/1996 | MacLeod et al. | |
| 5,721,538 A | 2/1998 | Tubel | |
| 6,114,972 A | 9/2000 | Smith | |
| 6,150,954 A | 11/2000 | Smith | |
| 6,177,882 B1 | 1/2001 | Ringgenberg | |
| 6,188,221 B1 | 2/2001 | Van de Kop et al. | |
| 6,218,959 B1 | 4/2001 | Smith | |
| 6,253,848 B1 | 7/2001 | Reimers et al. | |
| 6,657,597 B2 | 12/2003 | Rodney et al. | |
| 6,696,839 B2 | 2/2004 | Ellingsrud et al. | |
| 6,715,551 B2 | 4/2004 | Curtis et al. | |
| 6,717,411 B2 | 4/2004 | Ellingsrud et al. | |
| 6,739,165 B1 | 5/2004 | Strack | |
| 6,781,520 B1 | 8/2004 | Smith et al. | |
| 6,885,942 B2 | 4/2005 | Shray et al. | |
| 2003/0098799 A1* | 5/2003 | Zimmerman | 340/854.6 |
| 2004/0262008 A1* | 12/2004 | Deans et al. | 166/339 |
| 2005/0017723 A1 | 1/2005 | Entov et al. | |
| 2007/0024464 A1* | 2/2007 | Lemenager et al. | 340/853.1 |

FOREIGN PATENT DOCUMENTS

| | | |
|---|---|---|
| EP | 0 932 054 A2 | 7/1999 |
| EP | 0930518 A2 | 7/1999 |
| RU | 2124455 | 1/1999 |
| WO | 01/84291 A1 | 11/2001 |
| WO | WO-03025803 A1 | 3/2003 |
| WO | 2004/003329 A2 | 1/2004 |
| WO | 2004/003329 A3 | 1/2004 |

* cited by examiner

OTHER PUBLICATIONS

Decision on Grant from Russian Patent Office in counterpart application RU 2005133151/03(037117), dated Sep. 18, 2007, pp. 1-2.

*Primary Examiner*—William P Neuder
(74) *Attorney, Agent, or Firm*—Dan C. Hu; Daryl R. Wright; Bryan P. Galloway

(57) ABSTRACT

A subsea communication system includes devices in a wellbore and devices on a floor, where the devices in the wellbore and on the floor are able to communicate wirelessly with each other, such as through a formation.

12 Claims, 4 Drawing Sheets

WIRELESS COMMUNICATIONS ASSOCIATED WITH A WELLBORE

CROSS REFERENCE TO RELATED APPLICATIONS

The present application claims priority to U.S. Provisional application No. 60,522,673 filed Oct. 27, 2004.

BACKGROUND

The invention relates generally to wireless communications in wellbores. As technology has improved, various types of sensors and control devices have been placed in hydrocarbon wells, including subsea wells. Examples of sensors include pressure sensors, temperature sensors, and other types of sensors. Additionally, sensors and control devices on the sea floor, such as sand detectors, production sensors and corrosion monitors are also used to gather data. Information measured by such sensors is communicated to well surface equipment over communications links. Control devices can also be controlled from well surface equipment over a communications link to control predetermined tasks. Examples of control devices include flow control devices, pumps, choke valves, and so forth.

Exploring, drilling, and completing a well are generally relatively expensive. This expense is even higher for subsea wells due to complexities of installing and using equipment in the subsea environment. Running control lines, including electrical control lines, between downhole devices (such as sensor devices or control devices) and other equipment in the subsea environment can be complicated. Furthermore, due to the harsh subsea environment, electrical communications lines may be subject to damage, which would mean that expensive subsea repair operations may have to be performed.

SUMMARY

In general, methods and apparatus are provided to enable wireless communications between or among devices in an oilfield and in land or subsea wellbores.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Although the Figures illustrate the use of the present invention in a subsea environment, it is understood that the invention may also be used in land wells and fields.

Figure 1:
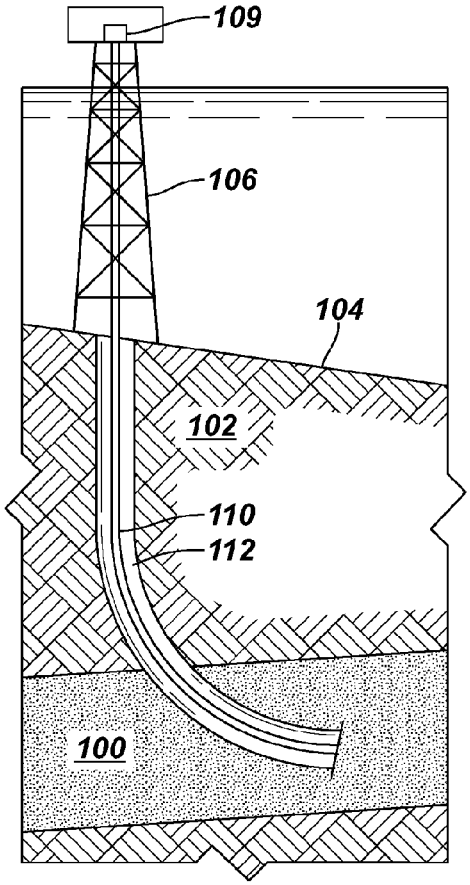
FIGS. 1 and 2 illustrate example subsea environments incorporating some embodiments of the invention.

FIG. 1 shows a first arrangement of a subsea environment that includes a reservoir 100 (such as a hydrocarbon reservoir) underneath an earth formation 102. The formation 102 defines a sea floor 104 on which a production platform 106 is located. The subsea environment of FIG. 1 is an example of a shallow water production environment that enables the production platform to be mounted on the sea floor 104. A production string 110 extends from a wellhead 108 through sea water and the formation 102 to the reservoir 100. A subsea wellbore 112 extends from the sea floor 104 through the formation 102 to the reservoir 100. The production string 110 extends through the subsea wellbore 112. As further shown in FIG. 3, electrical devices are located on the sea floor 104 as well as in the subsea wellbore 112.

In accordance with some embodiments of the invention, wireless communications (e.g., by use of electromagnetic signals, acoustic signals, seismic signals, etc.) can be performed between devices on the sea floor 104 and downhole devices in the subsea wellbore 112. In one embodiment, the devices on the sea floor 104 and in the subsea wellbore 112 are electrical devices. Also, wireless communications can be performed between the devices in the wellbore 112 and surface devices, such as a controller 109 located on the production platform 106. Additionally, wireless communications can occur between downhole devices inside the wellbore 112, or between devices on the sea floor 104.

Wireless signaling can be communicated through the formation through low-frequency electromagnetic signaling, which is subject to less attenuation in the formation. Another type of wireless signaling that can be communicated through the formation is seismic signaling.

The term "electrical device" refers to any device requiring electrical energy to operate. Such devices (or any other device) are capable of communicating wirelessly with other devices by use of the different wireless communication signals previously described. In one embodiment, each electrical device is connected to its own power supply (such as a battery or fuel cell or such as a direct power supply via seabed umbilicals). An electrical device includes either a sensor or a control device. A sensor refers to a device that is able to monitor an environmental condition, such a characteristic (e.g., temperature, pressure, etc.) in the subsea wellbore 112, a characteristic (e.g., resistivity, etc.) of the reservoir 100, or a characteristic (e.g., temperature, etc.) of the sea water. A control device is a device that is able to control operation of another component, such as a valve, packer, etc.

Figure 2:
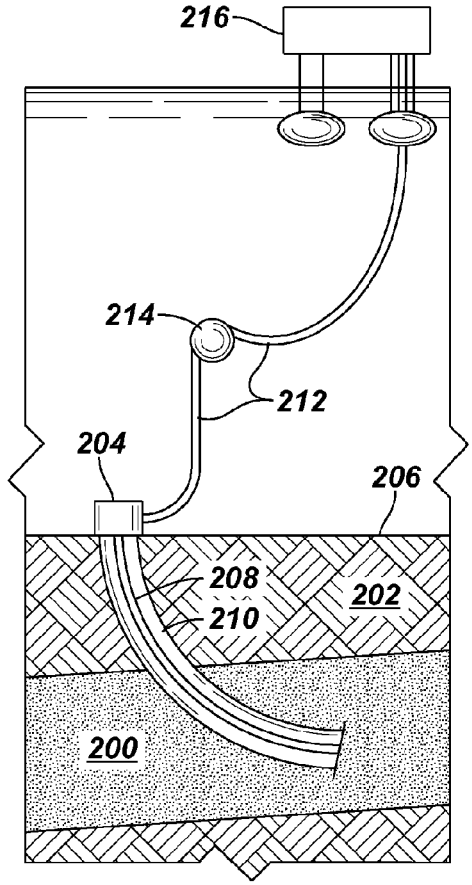

FIG. 2 illustrates another arrangement of a subsea environment that includes a reservoir 200 and an earth formation 202 above the reservoir 200. The FIG. 2 subsea environment is an example of a deep water subsea environment, in which the wellhead 204 is located at the sea floor 206. A production string 208 extends from the wellhead 204 into a subsea wellbore 210, with the production string 208 extending through the subsea wellbore 210 to the reservoir 200.

In one embodiment, the subsea wellhead 204 is coupled to a subsea conduit 212, which can be maintained in position in the sea water by a floating buoy 214. The conduit 212 extends upwardly to a floating production unit 216. As with the subsea environment of FIG. 1, devices, such as electrical devices, are located on the sea floor 206 as well as in the subsea wellbore 210. Also, electrical devices, such as a controller, are located on the floating production unit 216. Wireless communications can occur between the devices in the subsea wellbore 210 and devices on the sea floor 206, as well as with devices on the production unit 216. Also, wireless communications can occur between devices in the subsea wellbore 210, or between devices on the sea floor 206.

Figure 3:
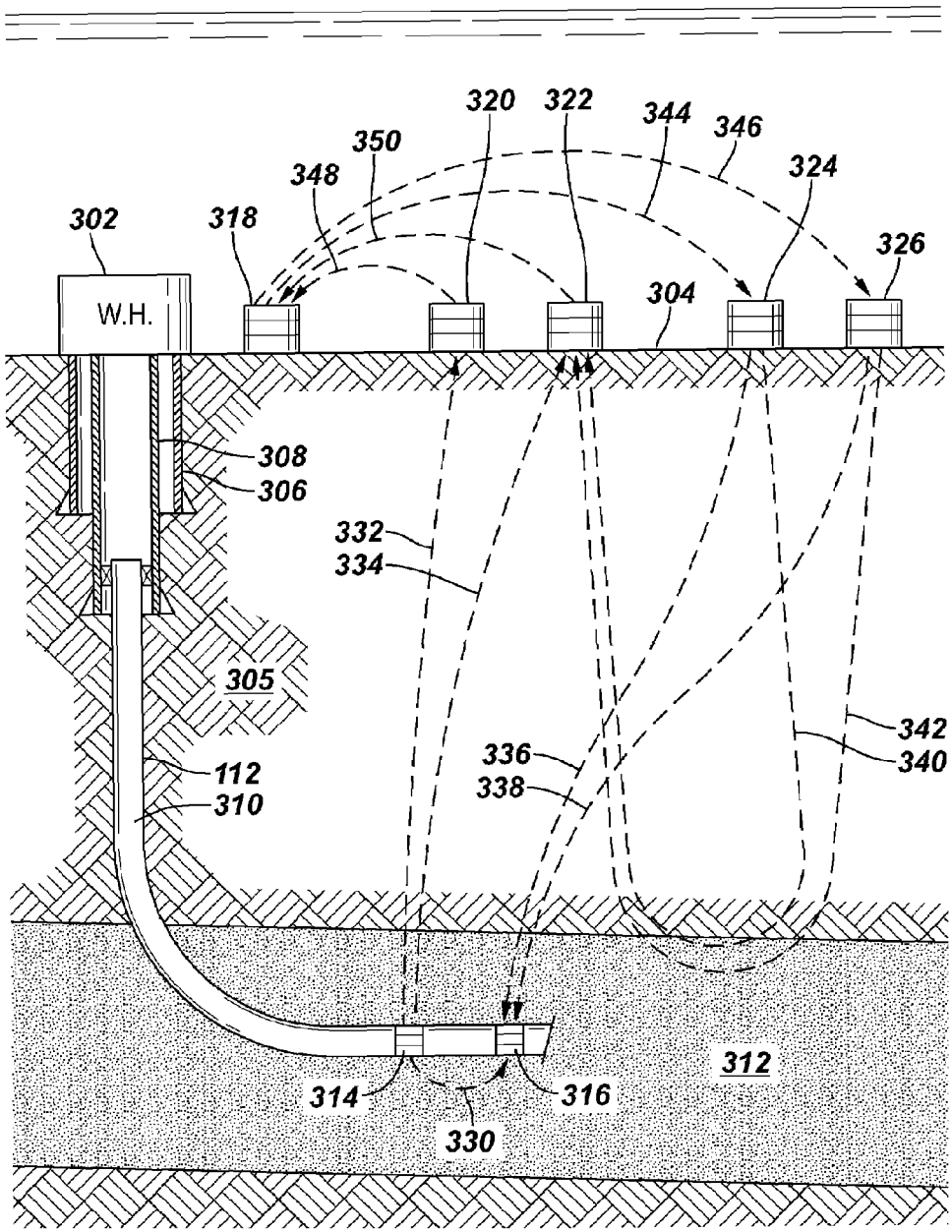
FIG. 3 illustrates wireless communication between or among subsea electrical devices and downhole electrical devices.

FIG. 3 illustrates example wireless communications between various devices, such as electrical devices. In FIG. 3, a wellhead 302 is located on sea floor 304. A subsea well is cased by casing sections 306 and 308. A production string 310 extends from a section of the subsea well into a reservoir 312. Electrical devices, such as sensors 314 and 316, are located in the production string 310 in the vicinity of the reservoir 312. Instead of being sensor devices, the electrical devices in the production string 310 can also be control devices, such as control devices for actuating valves, packers, perforating guns, and other downhole tools. Electrical devices can also be located elsewhere on the production string 310. In one embodiment, each electrical device 314, 316 includes either a transmitter or a receiver or both a transmitter and receiver ("transceiver").

FIG. 3 also depicts electrical devices 318, 320, 322, 324 and 326 located proximal the sea floor 304. Each of the electrical devices 318, 320, 322, 324, and 326 includes a transmitter or a receiver or a transceiver. An electrical device is "proximal" a sea floor if the electrical device is either on the sea floor or located a relatively short distance from the sea floor.

As depicted in FIG. 3, wireless communications 330 can occur between the production string electrical devices 314 and 316, in which a transmitter in the electrical device 314 transmits wireless signals (through the subsea wellbore and/or through the reservoir 312/formation 305) to a receiver in the electrical device 316. Also, the transmitter in the electrical device 314 can send (at 332, 334) wireless signals through a formation 305 to respective electrical devices 320 and 322. In one example implementation, the electrical device 314 is a sensor that is able to send measurement data through the formation 305 to respective receivers 320, 322. The receivers 320, 322 in turn communicate the received data (at 348, 350) to the electrical device 318. The electrical device 318 is connected by a communications link (optional) to sea surface equipment.

In the other direction, transmitters in the electrical devices 324 and 326 proximal the sea floor 304 can send (at 336, 338) wireless signals to the receiver in the electrical device 316 attached to the production string 310. For example, the electrical device 316 can be a control device that is actuated in response to commands carried in the wireless signals from the electrical devices 324, 326. The control device 316 can be instructed to perform predefined tasks.

Reservoir monitoring can also be performed from the sea floor 304. The electrical devices 324, 326 are able to transmit, at 340, 342 respectively, wireless signals through the formation 305 to the reservoir 312. The wireless signals at 340, 342 are reflected back from the reservoir 312 to a receiver in the electrical device 322. The modulation of the wireless signals by the reservoir 312 provides an indication of the characteristic of the reservoir 312. Thus, using the communications 340, 342 between the transmitters 324, 326 and the receiver 322, a subsea well operator can determine the content of the reservoir (whether the reservoir is filled with hydrocarbons or whether the reservoir is dry or contains other fluids such as water).

Wireless communications can also occur between electrical devices proximal the sea floor 304. For example, as depicted in FIG. 3, a transmitter in the electrical device 318 can transmit (at 344, 346) wireless signals, such as through sea water, to respective receivers in electrical devices 324 and 326. The wireless signals sent at 344, 346 can include commands to instruct the electrical devices 324, 326 to perform reservoir characteristic testing by sending wireless signals at 340, 342. Signals at 344 and 346 can also include commands for electrical devices 324 and 326 to send commands to instruct electrical devices 314 and 316 to perform a certain operation (i.e. set a packer or open a valve).

Also, the electrical devices 320, 322 are able to send (at 348, 350) wireless signals to the electrical device 318. The wireless signals sent at 348, 350 can carry the measurement data received by the electrical devices 320, 322 from the downhole electrical device 314.

The wireless communications among various electrical devices depicted in FIG. 3 are exemplary. In further implementations, numerous other forms of wireless communications can be accomplished between or among different combinations of downhole devices, devices proximal the sea floor, and sea surface devices.

In one specific example, transmitters in each of the electrical devices 324, 326 may be able to produce controlled source electromagnetic (CSEM) sounding at low frequency (few tenths to few tens hertz) electromagnetic signaling, combined with a magnetotelluric technique to map the resistivities of the reservoir (and hence hydrocarbon layers—as well as other layers—in the reservoir). Magnetotelluric techniques measure the earth's impedance to naturally occurring electromagnetic waves for obtaining information about variances in conductivity (or resistivity) of the earth's subsurface.

Figure 4:
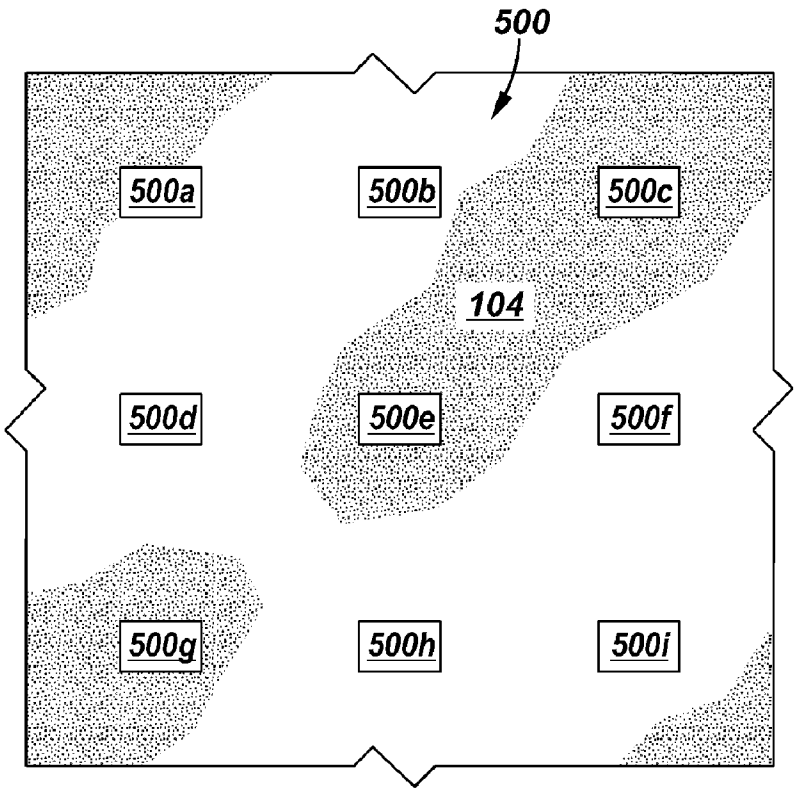

To enable this mapping and as shown in FIG. 4, a network 500 of electrical devices 500*a-i* can be deployed on the floor 104. Devices 500*a-i* are as described in relation to devices 318, 320, 322, 324 and 326 above. With the use of a network 500 on the floor (instead of one, two, or even a few devices), an operator can obtain a broad map of the reservoir 312.

The electrical devices 324, 326 (500*a-i*) can be electric dipole devices that include a high power source, such as a power source capable of producing 100 volts and 1,000 amps, in one example implementation. For receiving wireless signals reflected from the reservoir 312, the electrical devices 320, 322 (500*a-i*) include sensors/receivers to perform reservoir mapping based on the signals reflected from the reservoir 312. The electromagnetic mapping provides a complement to seismic mapping at the seismic scale for fluid determination to help reduce dry-hole scenarios. The electromagnetic mapping described here can be performed during an exploration phase.

Figure 5:
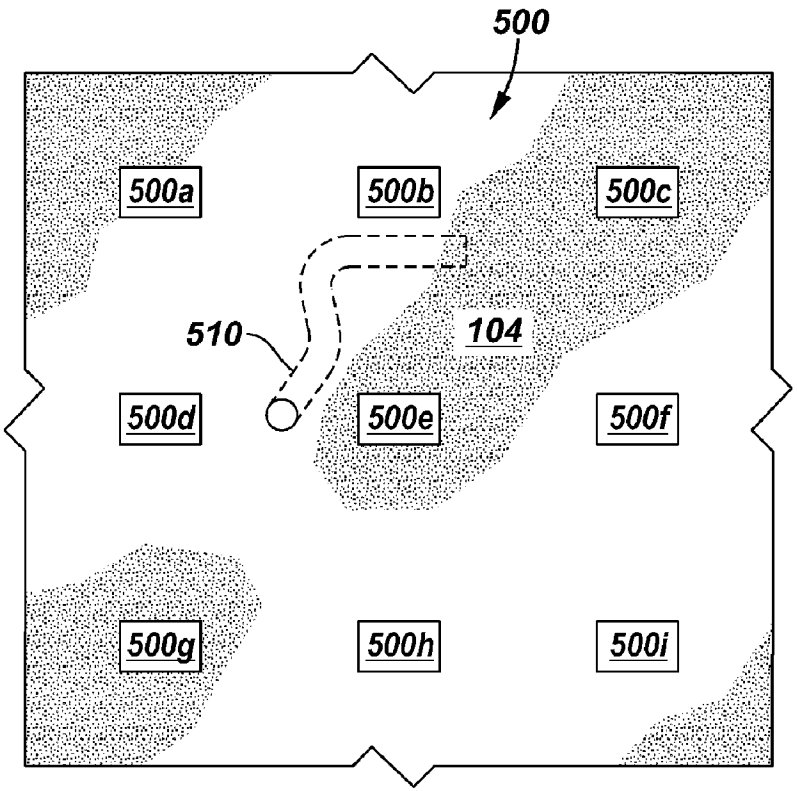
FIGS. 4 and 5 illustrate plan views of the network of devices that can be used in different phases of the wellbore life.
Figure 6:
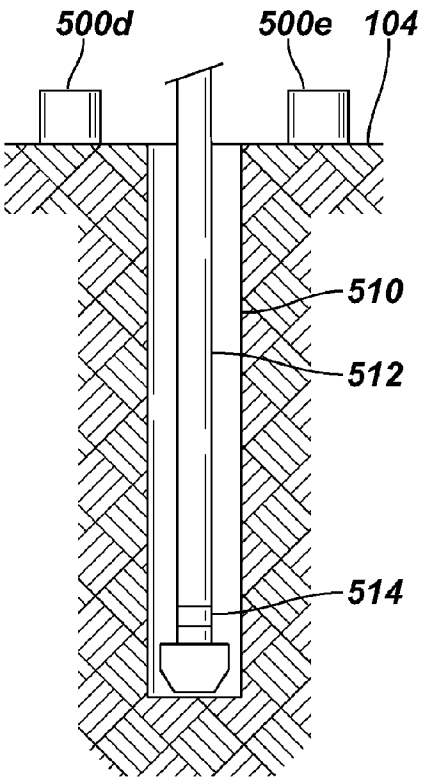
FIG. 6 illustrates the use of the network in the drilling phase of the wellbore life.

In a drilling phase and as shown in FIGS. 5 and 6, the same network 500 of sea floor receivers 320, 322 (500*a-i*) can be used to support drilling with electromagnetic telemetry. Drilling with electromagnetic telemetry provides feedback from the wellbore (shown in FIG. 5 as 510 in phantom lines) at all times, such as during mud circulating and non-circulating operations. As a result, a more secure well drilling environment can be achieved. In addition, the trajectory of drill string 512 in drilling wellbore 510 (see FIG. 6) can be more closely monitored and controlled. In this embodiment, drill string 512 carries the relevant receivers, transmitters, and/or transceivers 514 to enable communication with the devices 500*a-i*. Formation damage can also be reduced as the fluids can be controlled for formation purposes only, not as a telemetry channel. The receivers 320, 322 (500*a-i*) can be coupled with acoustic transmitters/receivers to make the link through the sea water to other electrical devices on the sea floor or with electrical devices on the sea surface.

With a well-established grid or network 500 of electromagnetic transmitters/receivers already in place from the exploration and drilling phases, the same network 500 can be used in the completion and/or production phases of the well. With the use of the network 500 and its wireless communication, completion operations can be enabled and made more efficient. Telemetry to individual downhole devices permits installations without intervention and also allows a higher degree of selectivity in the installation process. For example, operations relating to setting packers, opening or closing valves, perforating, and so forth, can be controlled using electromagnetic telemetry in the network of transmitters and receivers. The transmitters and receivers used for completion operations can be the same transmitters and receivers previously established during the exploration and drilling phases.

Production management activities can also capitalize on the already established network of devices 500*a-i*. With the established grid of in-well and sea floor transmitters and receivers, deep reservoir imaging and fluid movement monitoring can be accomplished. The benefit is the reduction, if not elimination, in the number of cables and control lines that may have to be provided for production purposes. For example, pressure gauges deep in the reservoir 312 can transmit to the network 500*a-i* without wires or cables. Fluid movement monitoring can be enabled with repeat electromagnetic sounding over time.

The use of the same network 500 of devices 500*a-i* for all phases or more than one phase of field development (exploration, drilling, completion, production) is beneficial because it gives an operator the highest use of capital and operational resources. The network 500 may even be used in other phases of the well, such as abandonment and leak monitoring.

The source of electromagnetic energy that enables the network 500 may be portable so that it can be brought back to the field when necessary thereby not leaving a valuable resource idle. Moreover, different sources can also be used depending on the power required by the wireless operation(s) to be carried out.

Figure 7:
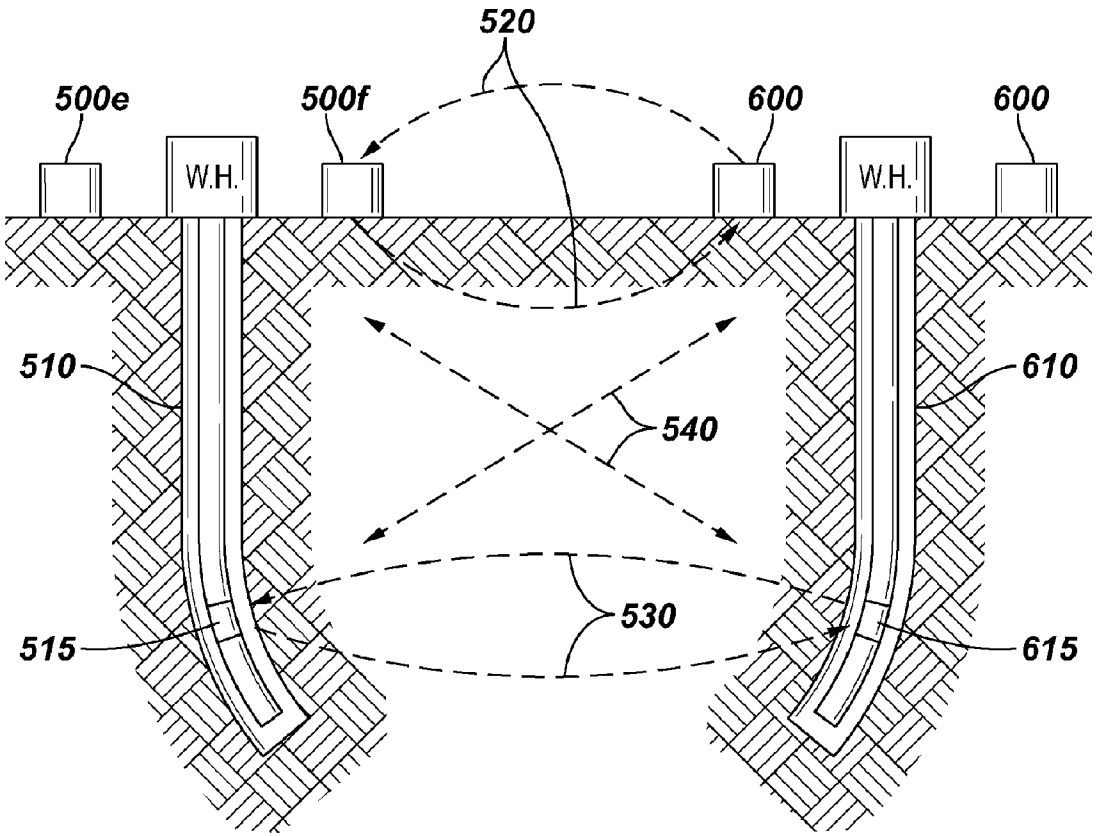
FIG. 7 illustrates wireless communication between two networks and wellbores.

In addition, as shown in FIG. 7, the network 500 of devices may wirelessly communicate with another network 600 of devices associated with another wellbore 610 or field. The first and second networks 500 and 600 may communicate with each other at 520. The downhole devices 515 and 615 associated with each network 500 600 may communicated with each other at 530. Or, each network 500 and 600 may communicate with the other's downhole devices 615, 515 at 540.

It is understood that a network may be associated with one or more wellbores. It is also understood that a network may be associated with one or more fields.

In an alternative embodiment, any of the network 500 devices may be hard wired to each other.

In one embodiment, the network and/or the downhole devices may include a wake-up feature that activates the network (to send the relevant signals) when particular events occur (downhole or elsewhere). The wake-up feature may also activate downhole devices to perform certain functions on the occurrence of particular events.

While the invention has been disclosed with respect to a limited number of embodiments, those skilled in the art will appreciate numerous modifications and variations there from. It is intended that the appended claims cover such modifications and variations as fall within the true spirit and scope of the invention.

What is claimed is:

1. A method for use in a subsea environment, comprising:

wirelessly communicating between electrical devices in a subsea wellbore and electrical devices proximal a sea floor through a formation;

sending, from a first one of said electrical devices proximal the sea floor, wireless signals into the formation; and receiving, at a second one of said electrical devices proximal the sea floor, a portion of the wireless signals reflected from a reservoir in the formation for determining a characteristic of the reservoir.

2. The method of claim 1, wherein wirelessly communicating through the formation comprises wirelessly communicating electromagnetic signaling through the formation.

3. The method of claim 1, further comprising performing the wireless communicating during an exploration phase for determining characteristics of a reservoir in the formation.

4. The method of claim 1, further comprising performing the wireless communicating during a drilling phase to provide feedback from the subsea wellbore.

5. The method of claim 1, further comprising performing the wireless communicating while completing a subsea wellbore.

6. The method of claim 1, further comprising wirelessly communicating between electrical devices proximal the sea floor.

7. The method of claim 1, further comprising wirelessly communicating between electrical devices in the subsea wellbore.

8. The method of claim 1, further comprising:

a third electrical device proximal the sea floor sending wireless signaling through sea water to a fourth electrical device proximal the sea floor; and in response to the wireless signaling from the third electrical device, the fourth electrical device sending, through the formation, wireless signaling into the formation to test a characteristic of a portion of the formation.

9. The method of claim 1, further comprising a sensor in the subsea wellbore sending measurement data in wireless signaling through the formation to a receiver proximal the sea floor.

10. The method of claim 9, further comprising the receiver sending, through sea water, the measurement data in wireless signaling to another electrical device proximal the sea floor.

11. A subsea well system comprising:

a first electrical device for positioning proximal a sea floor;

a second electrical device for location in a subsea wellbore, wherein the first and second electrical devices are adapted to communicate wirelessly through a formation separating the first and second electrical devices; and a third electrical device and a fourth electrical device proximal the sea floor, the third electrical device to send wireless signaling through the formation to a reservoir in the formation, and the fourth electrical device to receive wireless signaling reflected from the reservoir.

12. The subsea well system of claim 11, wherein the second electrical device comprises a sensor, the sensor to send measurement data in wireless signaling through the formation to the first electrical device.

* * * * *